US006863045B2

(12) United States Patent
Ricordi

(10) Patent No.: US 6,863,045 B2
(45) Date of Patent: Mar. 8, 2005

(54) COMBUSTION APPARATUS HAVING IMPROVED AIRFLOW

(75) Inventor: Christian Paul Andre Ricordi, Bourg-les-Valence (FR)

(73) Assignee: Illinois Tool Works Inc., Glenview, IL (US)

( * ) Notice: Subject to any disclaimer, the term of this patent is extended or adjusted under 35 U.S.C. 154(b) by 117 days.

(21) Appl. No.: 10/444,476

(22) Filed: May 23, 2003

(65) Prior Publication Data

US 2004/0231636 A1 Nov. 25, 2004

(51) Int. Cl.[7] ..... B25C 1/08

(52) U.S. Cl. ..... 123/262; 123/46 A; 123/46 H; 227/10; 60/39.6

(58) Field of Search ..... 123/262, 263, 123/268, 280, 285, 286, 24 R, 24 A, 46 A, 46 H; 227/10; 60/39.6

(56) References Cited

U.S. PATENT DOCUMENTS 5,197,646 A * 3/1993 Nikolich ..... 123/46 SC
6,460,507 B2 10/2002 Thieleke et al.
6,463,894 B2 10/2002 Hasler et al.
6,526,926 B1 3/2003 Towfighi
6,619,527 B1 * 9/2003 Moeller ..... 227/10
6,722,550 B1 * 4/2004 Ricordi et al. ..... 123/46 SC
6,779,493 B2 * 8/2004 Doherty et al. ..... 123/24 A
2002/0134069 A1 9/2002 Adams
2002/0134345 A1 9/2002 Adams
2002/0144498 A1 10/2002 Adams
2003/0222114 A1 * 12/2003 Nishikawa et al. ..... 227/10

* cited by examiner

*Primary Examiner*—Erick Solis
(74) *Attorney, Agent, or Firm*—Lisa M. Soltis; Mark W. Croll; Donald J. Breh

(57) ABSTRACT

A gas combustion-powered apparatus has a first chamber, a rotatable fan in the first chamber, an ignition source in operable relationship to the first chamber to ignite a combustible gas, and a second chamber. A communication passage is located downstream of the fan between the first chamber and the second chamber, and is constructed and arranged for enabling passage of an ignited gas jet from the first chamber to the second chamber. An intake port is located on a wall of the first chamber upstream of the fan, and a bypass port, separate from the communication passage, is located on the wall of the first chamber downstream of the fan.

23 Claims, 4 Drawing Sheets

COMBUSTION APPARATUS HAVING IMPROVED AIRFLOW

BACKGROUND OF THE INVENTION

The present invention relates to a combustion apparatus having improved airflow, and more specifically to a multiple-chamber combustion apparatus having improved airflow through the apparatus, as used in conjunction with combustion-powered fastener driving tools.

Gas combustion devices are known in the art. A practical application of this technology is found in combustion-powered fastener driving tools. One type of such tools, also known as IMPULSE® brand tools for use in driving fasteners into workpieces, is described in commonly assigned patents to Nikolich U.S. Pat. Re. No. 32,452, and U.S. Pat. Nos. 4,522,162, 4,483,473, 4,483,474, 4,403,722, 5,197,646, and 5,263,439, all of which are incorporated by reference herein. Similar combustion powered nail and staple driving tools are available commercially from ITW-Paslode of Vernon Hills, Ill. under the IMPULSE® brand, and from ITW-S.P.I.T. of Bourg-les-Valence, France under the PULSA® brand.

Such tools incorporate a generally pistol-shaped tool housing enclosing a small internal combustion engine. The engine is powered by a canister of pressurized fuel gas, also called a fuel cell. A battery-powered electronic power distribution unit produces a spark for ignition, and a fan located in a combustion chamber provides for both an efficient combustion within the chamber, while facilitating processes ancillary to the combustion operation of the device. Such ancillary processes include: inserting the fuel into the combustion chamber; mixing the fuel and air within the chamber; and removing, or purging, combustion by-products. In addition to these ancillary processes, the fan further serves to cool the tool and increase combustion energy output.

The combustion engine includes a reciprocating piston with an elongated, rigid driver blade disposed within a cylinder body. A valve sleeve is axially reciprocable about the cylinder and, through a linkage, moves to close the combustion chamber when a work contact element at the end of the linkage is pressed against a workpiece. This pressing action also triggers a fuel metering valve to introduce a specified volume of fuel into the closed combustion chamber.

A trigger switch is pulled, which causes the spark to ignite a charge of gas in the combustion chamber of the engine. Upon ignition of the combustible fuel/air mixture, the combustion in the chamber causes the acceleration of the piston/driver blade assembly, which shoots downward to impact a positioned fastener and drive the fastener into the workpiece if the fastener is present. The piston then returns to its original, or "ready" position, through differential gas pressures within the cylinder. Fasteners are fed magazine-style into the nosepiece, where they are held in a properly positioned orientation for receiving the impact of the driver blade.

Single-chamber combustion apparatuses are effective in achieving a fast combustion cycle time. Single-chamber apparatuses are also efficient for executing the ancillary processes described above, particularly mixing air and fuel within the single chamber and purging combustion by-products. Single-chamber apparatuses, however, do not generally realize peak combustion pressures as high as those seen in other gas combustion-powered tools.

Two or more-chambered combustion tools are also known. These tools can yield significantly higher combustion pressures, and therefore more combustion energy, over a single-chambered apparatus. Multiple-chambered tools typically have a first chamber connected to a second chamber. The first chamber often has a tubular shape, but can be a variety of shapes as are known in the art. An ignition source, which is typically a spark plug, is located in, or in operable relationship to, the first chamber. One end of the first chamber is also in communication with the second chamber via a port or other opening allowing communication between the chambers. The port connecting the two chambers typically includes a reed valve, which remains normally closed to prevent back flow of pressure from the second chamber into the first chamber.

A fuel/air mixture in the first chamber is ignited at one closed end of the first chamber, and advances a flame front toward another end of the chamber having the port. As the flame front advances, unburned fuel/air ahead of the flame front is pushed into the second chamber, thereby compressing the fuel/air mixture in the second chamber. As the flame propagates through the port and reed valve, the air/fuel mixture in the second chamber also ignites. This ignited gas thus rapidly builds pressure within the second chamber, and closes the reed valve to prevent loss of pressure back into the first chamber. The greater the compression in the second chamber, the greater will be the final combustion pressure of the tool, which is desirable. The combustion pressure is further increased as the path for the ignited gas to travel through the port between the first and second chambers is made more restrictive.

A restrictive path between the two chambers, however, makes it difficult to communicate the air/fuel mixture from the first chamber into the second chamber in a short amount of time. Multiple-chambered tools, therefore, typically provide fuel distribution to both chambers separately through a common fuel supply line with two orifices. Such configurations though, tend to increase the complexity and cost of the tool, which are undesirable. The restricted flow between both chambers also decreases the tool's ability to purge combustion by-products from both chambers, while inhibiting the tool's ability to fill the chambers with fresh air from outside of the tool, prior to injecting fuel to the chambers. Build-up of combustion by-products within the tool's chambers can decrease the tool's ability to realize consistent and repeatable combustion cycles. Alternatively, the restricted airflow between the two chambers requires additional time both to mix fuel within the chambers and to purge the chambers between combustion events. This extra time can be unfavorably noticeable to a tool operator while the tool is in use.

Accordingly, it is desirable to achieve an efficient airflow from one chamber to another in a multiple-chamber combustion tool apparatus, without sacrificing the increased combustion power resulting from use of a restrictive path between chambers, and without having to employ more than one fuel line in the apparatus.

SUMMARY OF THE INVENTION

The above-listed concerns are addressed by the present gas combustion-powered apparatus, which features a multiple-chamber structure utilizing a fan in one chamber. A restrictive path of airflow is provided between the chambers during combustion events, but airflow between chambers bypasses the restrictive path during mixing, purging, and cooling events in a combustion cycle. Bypass ports are provided for connecting the chambers together, and can be closed during combustion events to limit airflow to the restrictive path but, otherwise, open for mixing, purging, and cooling events occurring between combustion events.

More specifically, the present invention provides a gas combustion-powered apparatus which includes a first chamber, a rotatable fan located in the first chamber, an ignition source in operable relationship to the first chamber to ignite a combustible gas, and a second chamber. A first communication passage between the first chamber and the second chamber and downstream of the fan is constructed and arranged for enabling passage of an ignited gas from the first chamber to the second chamber. Separate from the first communication passage is an intake port, which is located on a wall of the first chamber upstream of the fan, and a bypass port, which is located on the wall of the first chamber downstream of the fan.

In another embodiment, a gas combustion-powered apparatus includes a combustion chamber, a piston chamber housing a moveable piston, and a sleeve chamber moveable relative to the combustion chamber and the piston chamber. The sleeve chamber has a first sliding position which allows unrestricted airflow between the first and second chambers, and from outside the apparatus into at least one of the first and second chambers. The sleeve chamber also has a second sliding position which allows unrestricted airflow between the first and second chambers, but blocks airflow from outside the apparatus into the first and second chambers. The sleeve chamber even further has a third sliding position which restricts airflow between the first and second chambers, and blocks airflow from outside the apparatus into the first and second chambers.

In still another embodiment, a method of operating a combustion-powered apparatus, which has a combustion chamber, a sliding chamber, and a piston chamber, includes the steps of providing air and injecting fuel into the combustion chamber, and mixing the air and fuel in both the combustion chamber and the sliding chamber by operating a rotating fan in the combustion chamber. At least one upstream port is located on a wall of the combustion chamber upstream of the fan and in communication with the sliding chamber, and at least one downstream port is located on the wall downstream of the fan and also in communication with the sliding chamber. After mixing, the mixed air and fuel is ignited in the combustion chamber and communicated to the sliding chamber through a flame jet port in the combustion chamber. Combustion pressure in the sliding chamber then drives a piston in the piston chamber. Combustion by-products are then purged from the combustion chamber and the sliding chamber by sending fresh air from outside the apparatus through the combustion chamber and the sliding chamber.

DETAILED DESCRIPTION OF THE INVENTION

Figure 1:
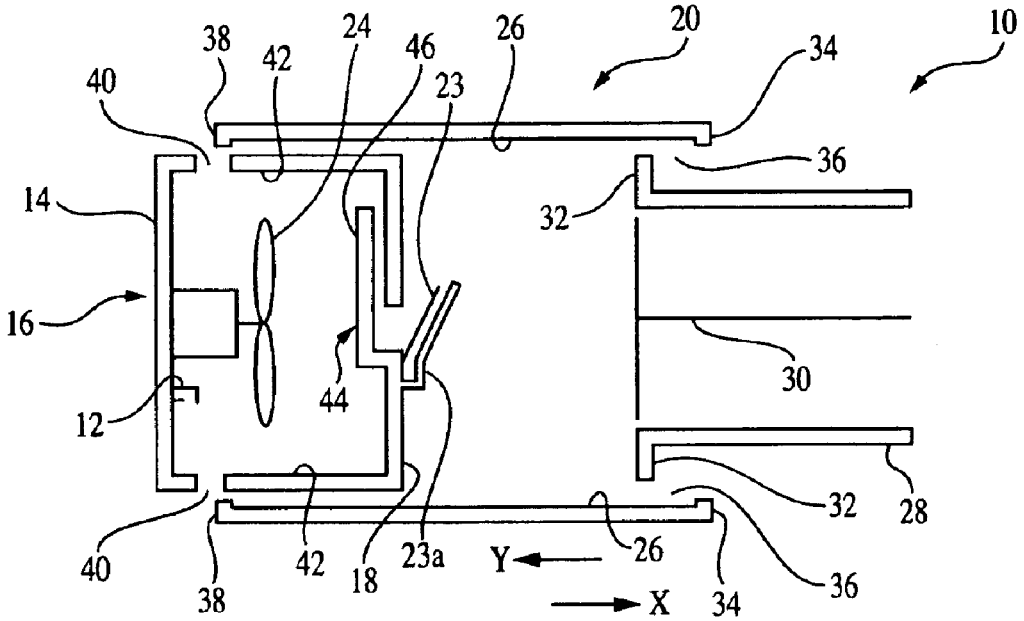
FIG. 1 is a schematic sectional view of a multiple-chamber combustion-powered apparatus.
Figure 2:
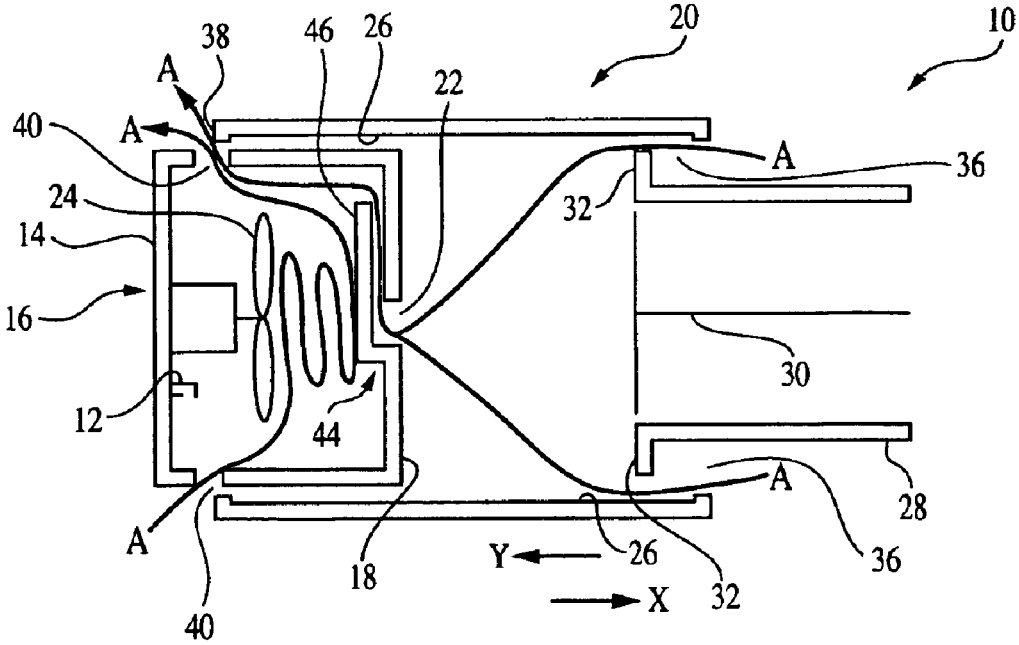
FIG. 2 is a schematic sectional view illustrating airflow through the combustion-powered apparatus depicted in FIG. 1.

Referring now to FIGS. 1 and 2, a preferred multiple-chamber apparatus design is described as in a copending, commonly assigned U.S. Patent application Ser. No. 10/170,736, which is incorporated by reference herein. A two-chamber apparatus is generally designated 10, and includes an ignition source 12, which is typically a spark plug, located at one closed end 14 of a first chamber 16. Another end 18 of the first chamber 16 is in communication with a second chamber 20 via a flame jet port 22. Preferably disposed to cover the flame jet port 22 on the outside of the first chamber 16 is a reed valve 23 (FIG. 1), which remains normally closed to prevent backflow of pressure from the second chamber 20 into the first chamber 16, and a valve limiter 23*a* disposed to cover the valve on a side of the valve opposite the first chamber.

The first chamber 16 operates as a compressor for a combustible gas in the second chamber 20. Fuel and air in the first chamber 16 is mixed by a rotating fan 24 in the first chamber, and is ignited by the ignition source 12 at the closed end 14 of the chamber 16. The ignited mixture advances a flame front toward the end 18 of the first chamber 16 including the flame jet port 22. As the flame front advances, unburned fuel/air ahead of the flame front is pushed into the second chamber 20, thereby compresses a fuel/air mixture in the second chamber. As the flame propagates from the first chamber 16, through the flame jet port 22, and into the second chamber 20, the air/fuel mixture in the second chamber also ignites. This ignited gas in the second chamber 20 thus rapidly builds even greater pressure in the second chamber, and closes the reed valve 23 to prevent loss of pressure back into the first chamber. A well-mixed air/fuel mixture in the second chamber 20 contributes to a faster, higher-energy, and more efficient combustion.

The second chamber 20 includes a generally cylindrical sleeve body 26, which slidably accommodates both the first chamber 16, and a generally cylindrical piston chamber 28. The piston chamber 28 houses a piston 30 for reciprocal movement therein, and a flared end 32 of the piston chamber 28 contacts an end 34 of the sleeve body 26 to effectively seal an opening 36 to air outside the apparatus 10, located between the second chamber 20 and the piston chamber 28, when the sleeve body 26 slides into position in the direction Y. Another end 38 of the sleeve body 26 contacts the closed end 14 of the first chamber 16 to effectively close off airflow from outside of the apparatus 10 through an intake port 40 located on a wall 42 of the first chamber 16 at a position upstream of the rotation of the fan 24. After the sleeve body 26 is positioned to block airflow from outside of the apparatus at both sleeve ends 34, 38, a rapid increase in combustion pressure in the second chamber 20 drives the piston 30 down the piston chamber 28 in a direction away from the first chamber 16.

In such configurations, when more than one chamber is used with one fan, efficiency of the fan 24 can be significantly affected by the way in which the chambers 16 and 20 are designed and connected. Greater combustion energy can be achieved in multiple-chamber apparatuses by establishing a restrictive path for the ignited gas mixture to flow from the first chamber 16 into the second chamber 20. Combustion energy further increases as the path between the first chamber 16 and the second chamber 20 becomes more restrictive. Such a restrictive path 44 is shown to be disposed over the flame jet port 22 on the interior of the chamber 16.

The restrictive path 44 in this example is formed by the placement of a shroud 46 over the flame jet port 22 on one side of the flame jet port, and the placement of a valve 23 and valve limiter 23*a* combination on the other side. It is contemplated that restrictive paths may be created by any combination of one or more shrouds, ports, valves, valve limiters, and the like. It is also contemplated that supersonic nozzles, as are known in the art, may alternatively be used to increase combustion energy through the flame jet port 22 as the flame jet port itself, or in combination with any all of the features described above.

Although highly restrictive paths can desirably increase the combustion energy transmitted from the first chamber 16 into the second chamber 20 during combustion events, restrictive paths may also undesirably restrict airflow between the two chambers, as described above, to complete the ancillary processes between combustion events. An undesirable tradeoff therefore can exist between the restrictive path, which is configured to extract more power from combustion, and the ability of the multiple-chamber apparatus to recirculate, or "breathe," air, fuel, and combustion by-products properly with one fan. This tradeoff is not very significant in single-chamber combustion configurations. The presence and operation of the fan 24 in the first chamber greatly contributes to the ability of the apparatus 10 to mix, cool, and purge the chambers, and reset the apparatus for a next combustion cycle. Efficient airflow between the chambers, however, is still difficult to achieve when utilizing a restrictive path.

Referring now to FIG. 2, a path of airflow A, as discovered by the present inventor, is shown as actually occurring during a purging event of combustion by-products in both the first chamber 16 and the second chamber 20 after a combustion event. During purging, the sleeve body 26 slides in a direction X to disengage from the piston chamber 28, and to expose the intake ports 40 to fresh air from outside of the apparatus 10. As the fan 24 rotates, fresh air from outside of the apparatus 10 ideally enters into the first chamber 16 through the intake ports 40, moves downstream of the fan 24 through the flame jet port 22 into the second chamber 20, and exits the second chamber through the opening 36, thus purging both chambers of combustion by-products left from a previous combustion event, and while filling both chambers with clean air.

As shown, however, the restrictive path 44 between the chambers 16, 20 greatly impedes the ability of the airflow A to travel evenly from the intake ports 40 to the opening 36. Such an ideal airflow path is even more difficult to achieve with configurations utilizing even more highly restrictive paths to increase combustion power. Most of the airflow A, as best seen in FIG. 2, actually remains in the first chamber 16, and exits the first chamber through some of the intake ports 40 instead of the flame jet port 22, resulting in an inefficient purging of the first chamber. The ability to purge the second chamber 20 becomes even more inefficient. Instead of the airflow traveling from the first chamber 16, through the second chamber 20 to exit the apparatus at opening 36, because of Bernoulli principles, some of the airflow A is actually pulled in the opposite direction from the second chamber 20 back into the first chamber 16. This reverse airflow does not significantly purge the second chamber 20. The effect of this reverse airflow, with respect to an ability to purge the second chamber 20, is further reduced to practically nothing when a valve is employed to prevent backflow from the second chamber into the first chamber 16.

Although the rotating fan 24 in the first chamber 16 improves the ability of the apparatus 10 to mix and purge both chambers 16, 20, the tradeoff noted above still exists to some extent. The present inventor has discovered that an effective restrictive path limits the ability of the fan 24 to efficiently mix air and fuel together in the second chamber 20 as well as in the first chamber 16 prior to a combustion event, without also utilizing a separate fuel line into the second chamber, as described above. Although also improved through by the rotation of the fan 24, the somewhat limited airflow through the second chamber 20 also reduces the ability of the fan 24 to cool the second chamber between combustion events. Accordingly, the present inventor found it desirable to achieve an efficient airflow from one chamber to the next in a multiple-chamber apparatus, while utilizing the unique properties of employing a fan within the first chamber, but without sacrificing the increased combustion power resulting from use of a restrictive path between chambers, and without having to use more than one fuel line.

Figure 3:
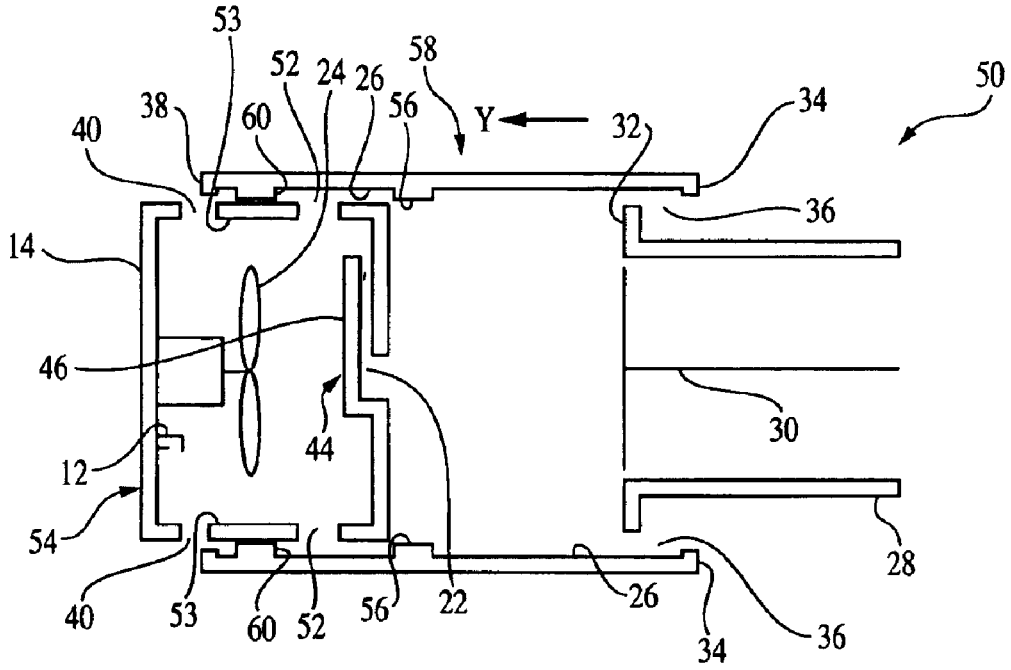
FIG. 3 is a schematic sectional view of a multiple-chamber combustion-powered apparatus featuring the present airflow configuration.
Figure 4:
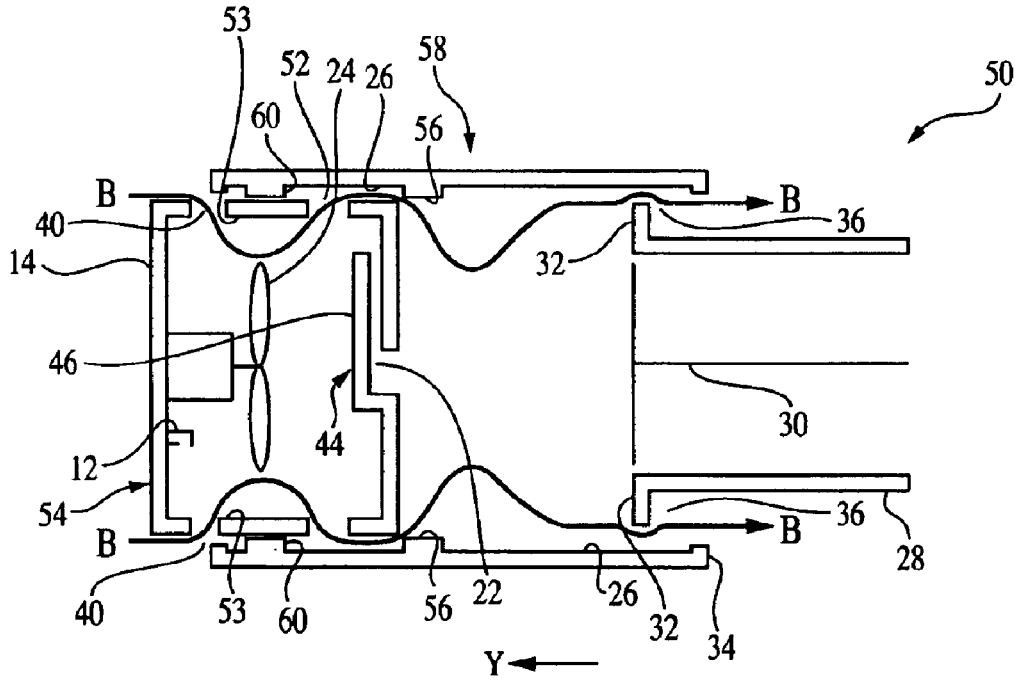
FIG. 4 is a schematic sectional view illustrating airflow through the apparatus depicted in FIG. 3.

Referring now to FIGS. 3–4, a combustion-powered apparatus is generally designated 50, but features of the apparatus 50 that are the same as those described above with reference to FIGS. 1 and 2 are identified by the same numerical designations.

An important feature of the apparatus 50 is that at least one bypass port 52 is located on a wall 53 of a preferred first chamber 54, but preferably several bypass ports 52 are evenly distributed around the preferably continuous cylindrical wall 53. In a preferred embodiment, the bypass ports 52 are located downstream of the flow of the fan 24, nearest a higher pressure region of the first chamber 54 created by the fan. The intake ports 40, located upstream of the fan 24, are therefore positioned nearest a lower pressure region of the first chamber 54. The bypass ports 52 thus create a second means of communication between the chambers other than the flame jet port 22 of the restrictive path 44.

The bypass ports 52 remain normally open, but may preferably be blocked by a bypass seal 56 located on the interior of the valve sleeve 26 defining a second chamber 58. The bypass seal 56 is preferably located on the valve sleeve 26 to completely cover the bypass ports 52 when the valve sleeve slidably engages the first chamber 54 and the piston chamber 28, in a direction Y, prior to a combustion event. As best seen in FIGS. 3 and 4, the bypass seal 56 should be preferably located on the valve sleeve 26 to avoid blocking airflow through the bypass ports 52 when the valve sleeve slides to expose both the first chamber 54 and the second chamber 58 to outside air for purging.

The bypass seal 56 is preferably made from the same solid-structure, combustion-resistant material as the second chamber 58, as such materials are known in the art. The bypass seal 56 may preferably be integrally formed as a unitary structure with the interior of the valve sleeve 26, but may be alternatively fixedly attached to the valve sleeve by welding, bonding, screws, or other methods of attachment known in the art.

Similar to the bypass seal 56, at least one intake seal 60 is also preferably located on the interior of the valve sleeve 26 to slidably engage and block airflow through the intake ports 40 during combustion events, but to leave the intake ports open to outside air when the valve sleeve slides open to facilitate purging. The intake seal 60 is preferably formed of the same material as the bypass seal 56, and attached to the valve sleeve 26 in a similar manner.

In a preferred embodiment, both the bypass seal 56 and the intake seal 60 are single, continuous bodies around the entire interior of the valve sleeve 26, or a series of separate, spaced bodies positioned to cover respective of the bypass ports 52 and intake ports 40 when the valve sleeve slides to close off outside airflow into the apparatus 50 for a combustion event. The bypass seal 56 and the intake seal 60 therefore need not be configured to permit airflow between the seals and the interior of the valve sleeve 26 itself.

Referring now to FIG. 4, an airflow path B during a purging event is shown for the apparatus 50 utilizing the bypass ports 52. In this embodiment, the path B smoothly and efficiently travels from the intake ports 40, out the bypass ports 52, through the second chamber 58, and out the opening 36 between the end 34 of the second chamber 58 and the preferably flared end 32 of the piston chamber 28. Another advantage of the unrestricted opening of the bypass ports 52 is the facilitation of the airflow path B to effectively avoid the restrictive path 44 (unlike in FIG. 2), thereby allowing significant quantities of clean air to rapidly move through the first chamber 54 and the second chamber 58 in the desired direction of the flow from the fan 24. The present multiple-chamber apparatus 50 thus may be rapidly and efficiently purged of combustion by-products when the second chamber 58 opens to disengage the first chamber 54 and the piston chamber 28 during purging events.

Furthermore, according to this preferred configuration, airflow from the fan 24 through both of the chambers 54, 58 becomes practically as efficient as that which is realized by a typical single-chamber apparatus using a fan. This advantageously efficient airflow improves the cooling of the first chamber 54, in addition to the second chamber 58, which both heat up after combustion events. Additionally, the ports 40, 52 and the seals 56, 60 may be preferably positioned to facilitate mixing of air and fuel between the first chamber 54 and the second chamber 58.

Figure 5A:
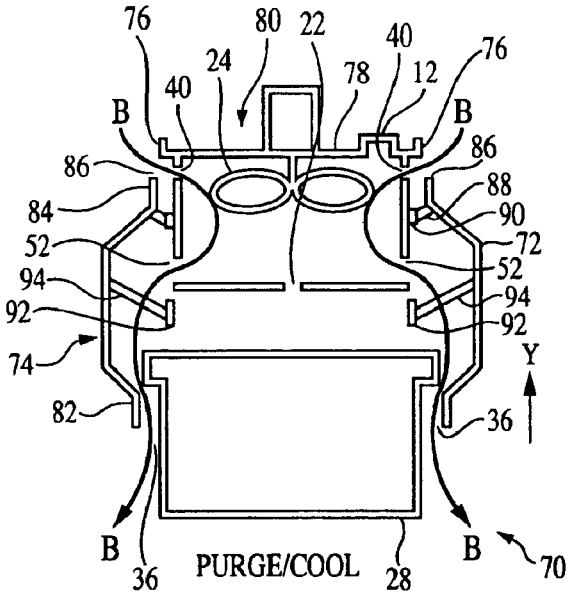
FIGS. 5A–C are schematic sectional views of another embodiment of the present apparatus illustrating preferred airflow features.
Figure 5B:
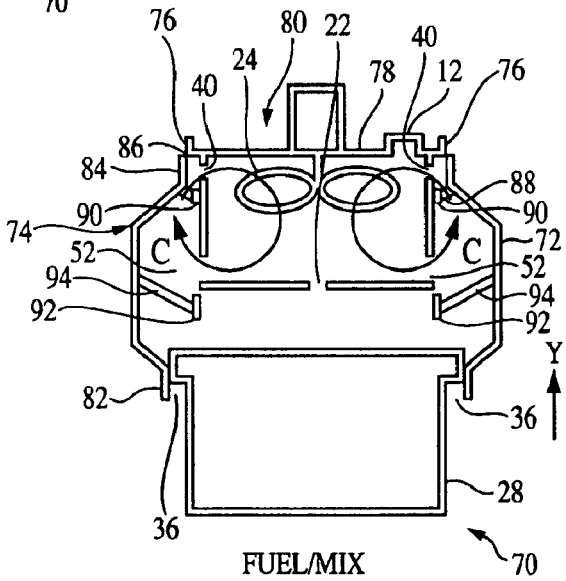
Figure 5C:
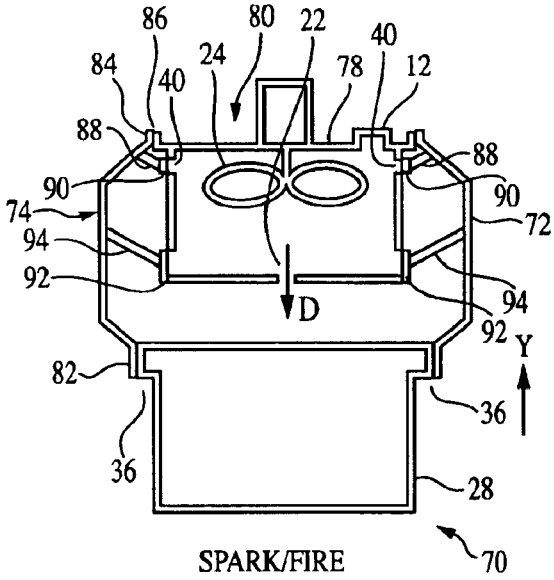

Referring now to FIGS. 5A–C, another alternative multiple-chamber combustion-powered apparatus is generally designated 70, and shown in simplified form to illustrate the effects of different sliding positions of a valve sleeve 72 of a second chamber 74. Components shared with apparatuses 10, 50 are designated by identical reference numbers. The second chamber 74 need not be a pure cylinder, but may take a variety of shapes to accommodate a desired size, as long as the second chamber can move in the direction Y to seal an edge 76 of a closed end 78 of a first chamber 80, in addition to the piston chamber 28. A configuration is preferred which also allows the second chamber 74 to slidingly engage with, and disengage from, both the first chamber 80 and the piston chamber 28 when the associated apparatus 70 is pressed upon, or lifted from a workpiece due to a linkage connected to a workpiece contact element (not shown), during operation of the apparatus, as is known in the art.

As best seen in FIG. 5A, purging and cooling of the apparatus 70 occurs when a venting end 82 of the valve sleeve 72 is fully disengaged from the piston chamber 28 at opening 36, and an intake end 84 of the valve sleeve is fully disengaged from the first chamber 80 to create an opening 86 between the intake end and the edge 76 of the closed end 78 of the first chamber. For this embodiment, the first chamber 80 and the piston chamber 28 are most preferably fixed relative to one another, and purging and cooling occur when the second chamber 74 is fully disengaged from the other chambers at a first sliding position. In this configuration, airflow through the apparatus 70 then follows the same path B shown in FIG. 4, and takes a direction which is practically unaffected by whether or not a restrictive path (not shown) is utilized to cover the flame jet port 22. In this alternative preferred embodiment, any airflow through the flame jet port 22 will be realized in the desired direction of flow from the rotating fan 24, and would even serve to improve the purging of combustion by-products from the first chamber 80 and the second chamber 74.

Referring now to FIG. 5B, as the apparatus 70 is placed against a workpiece, the valve sleeve 72 moves to a second sliding position to facilitate mixing of air and fuel between the first chamber 80 and the second chamber 74, and without any further modifications required to the structure of the apparatus 70. Alternatively, the valve sleeve 72 may be actuated to move as a result of an operator pulling a trigger (not shown). According to this embodiment, the venting end 82 and the intake end 84 should preferably be of sufficient length facing the piston chamber flared end 32 and the first chamber edge 76 respectively, such that second sliding position of the valve sleeve 72 seals the piston chamber 28 and the first chamber 80 at openings 36 and 86 respectively from the environment outside the apparatus, but leaves ports 40, 52 uncovered to allow airflow between the first chamber 80 and the second chamber 74.

With the piston chamber 28 and the first chamber 80 closed to outside air, the rotating fan 24 draws airflow in the direction C from the second chamber 74 into the first chamber 80 through the intake ports 40 located upstream of the fan. The fan 24 thus directs the airflow C out of the first chamber 80 and back into the second chamber 74 through the bypass ports 52 located downstream of the fan. This preferred configuration allows air and fuel to rapidly and efficiently mix within and between both chambers. In other words, an airflow connection to outside of the apparatus is closed, but recirculation between the chambers inside of the apparatus is maintained while fuel is injected into the first chamber 80. This efficient mixing process enables the resultant air/fuel mixture in the first chamber 80 to be rapidly communicated to the second chamber 74, thereby eliminating any need to inject fuel into both chambers through separate fuel lines. Similarly, the fuel may instead be injected into only the second chamber 74, yet still efficiently mixed into the first chamber 80 by the same process and configuration. According to this embodiment, a single fuel line for injecting fuel into only one of the chambers 74, 80 can adequately and reliably serve the entire apparatus 70.

A fuel trigger (not shown) for activating fuel injection may also be located on the apparatus 70 to enable mechanical activation by the sliding valve sleeve 72. The fuel trigger would preferably not come into contact with the valve sleeve 72 until after the valve sleeve had moved to seal the first chamber 80 and the second chamber 74 from the environment outside of the apparatus 70. Another preferred feature of this embodiment is to include an open portion 88 of an alternative intake seal 90, between the intake seal and the interior of the valve sleeve 72. The open portion 88 allows the airflow C to circulate in the second chamber 74 between the wall 53 of the first chamber 80 and the valve sleeve 72, and back into the first chamber through the intake ports 40. As best seen in FIG. 5B, recirculation through airflow path C can still occur between the first chamber 80 and the second chamber 74, even when the valve sleeve 72 closes the opening 86 between the first chamber 80 and the second chamber 74. A bypass seal 92 is preferably also spaced similarly to the intake seal 90 along the valve sleeve 72, and includes a similar open portion 94 which allows airflow through a portion of the bypass seal between the bypass seal and the valve sleeve.

Referring now to FIG. 5C, the valve sleeve 72 is further moved, from continued contact with the workpiece or trigger action, to a third sliding position which can complete insulation of the first chamber 80 from the second chamber 74, except for the flame jet port 22 and the restricted path 44 (FIG. 4), during a combustion event. The venting end 82 and the intake end 84 of the valve sleeve 72 continue to seal the first chamber 80 and the second chamber 74 from the outside environment, as with the second sliding position (best seen in FIG. 5B), but now the intake seal 90, and preferably the bypass seal 92 as well, are also moved to a position to block all airflow through the ports 40 and 52. Communication between the first chamber 80 and the second chamber 74 is therefore limited to the flame jet port 22 and the restricted path 44 for this third sliding position. The communication preferably takes the form of an ignited gas flame jet traveling in a one-way direction through the flame jet port 22 in the direction D. Although the single flame jet port 22 and the restrictive path 44 is the preferred configuration, additional flame jet ports 22 are contemplated. The present inventor further contemplates that the bypass ports 52 may also allow communication of the flame front from the first chamber 80 into the second chamber 74 without using additional flame jet ports.

A firing trigger (not shown) may also be located on the apparatus 70 to allow the valve sleeve 72 to mechanically activate a trigger for the ignition source 12 (FIG. 4), by movement of the valve sleeve, to ignite the air/fuel mixture within the first chamber 80 upon reaching the fully-engaged third sliding position shown in FIG. 5C. The resultant ignited gas jet will build a combustion pressure traveling into the second chamber 74, while igniting the air/fuel mixture in the second chamber and driving the piston 30 (FIG. 4) in the piston chamber 28 as described above. Upon completion of this combustion event, the valve sleeve 72 returns to the first sliding position shown in FIG. 5A to purge combustion by-products in the chambers 74, 80, cool both chambers, and restart the combustion cycle.

Figure 6:
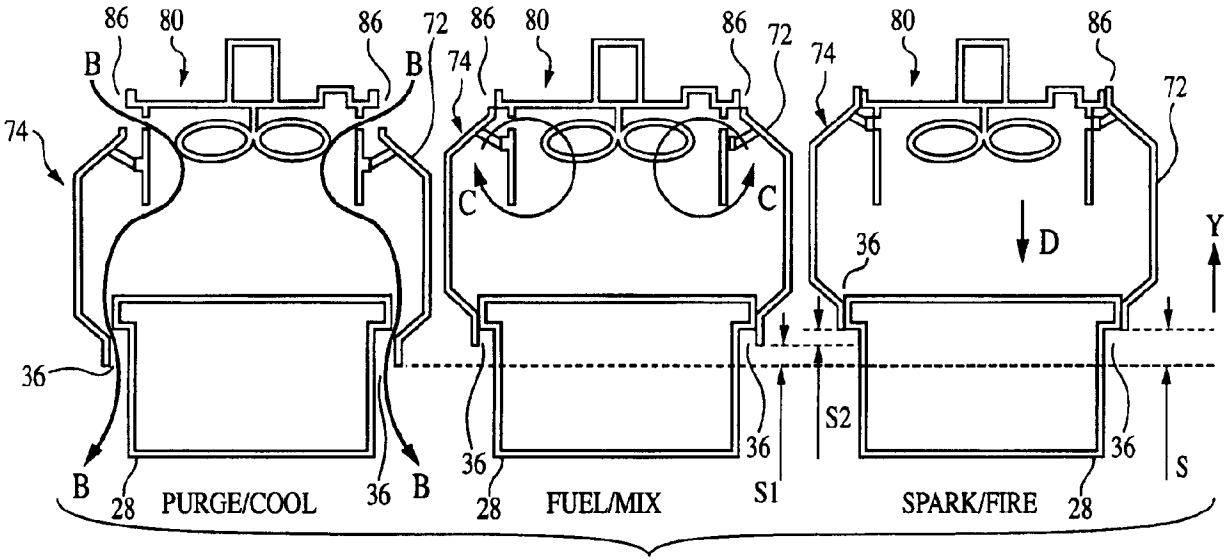
FIG. 6 is a partial schematic sectional view illustrating airflow as a function of stroke movement of the embodiment depicted in FIGS. 5A–C.

Referring now to FIG. 6, airflow through the apparatus 70 is shown as a function of the total stroke length S of the valve sleeve 72. The stroke length S is determined by the distance the valve sleeve 72 travels in the direction Y from its fully engaged position (combustion event) to its fully disengaged position (purging event). In this embodiment of the present invention, it is preferable to set the respective lengths of the venting end 82 and intake end 84 to allow for mixing to occur along a majority of the stroke length S.

An overall stroke length S is set to preferably both actuate and close the sliding valve sleeve 72 of the second chamber 74. A first fraction S1 of the stroke length S in the direction Y closes the openings 36 and 86 to seal the first chamber 80 and the second chamber 74 from the outside environment, while leaving airflow to continue to circulate along path C within the apparatus 70 for mixing. A second fraction S2 of the stroke length S, also in the direction Y, closes the intake seal 90 over the intake port 40 and the bypass seal 92 over the bypass port 52 to seal the first chamber 80 first the second chamber 74, except for the flame jet port 22 and restricted path 44, for combustion. The distances the valve sleeve 72 travels relative to the first chamber 80 and the piston chamber 28 therefore satisfies the equation: $S \geqq S1 + S2$.

In this preferred embodiment, the length of the stroke S where mixing occurs (S2) is preferably made relatively long with respect to the overall stroke length S to allow a maximum amount of mixing of air and fuel in both the first chamber 80 and the second chamber 74. S2 can therefore be set according to the respective lengths of the venting end 82 and the intake end 84 of the valve sleeve 72. The relative position of the intake seal 90 and the bypass seal 56 can also contribute to setting a preferably longer stroke fraction S2 for mixing. This longer stroke fraction S2 length can thus enable an enhanced mixing of fuel and air in both the first chamber 80 and the second chamber 74 irrespective of how highly restrictive the restrictive path 44 between chambers is made.

Figure 7:
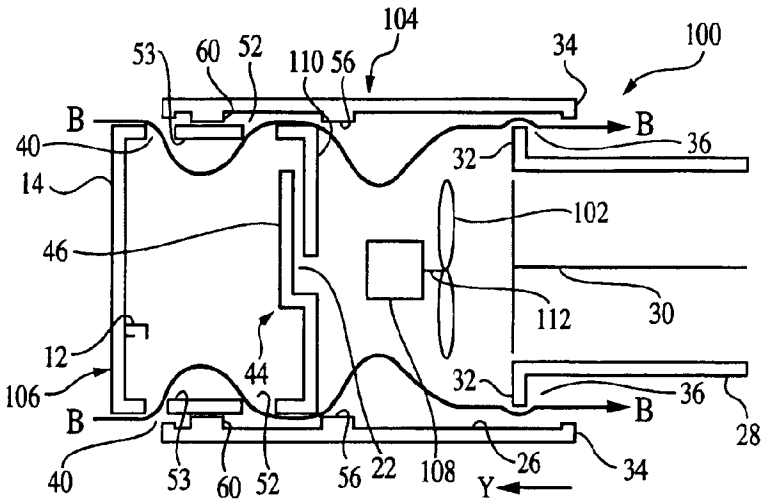
FIG. 7 is a schematic sectional view illustrating airflow through a still further embodiment of the present apparatus.

Referring now to FIG. 7, a still further alternative apparatus is generally designated 100, and components shared with the previous embodiments are designated by identical reference numbers. The apparatus 100 is similar to the apparatus 50 illustrated in FIG. 4, but locates a fan 102 in a moveable second chamber 104 instead of a first chamber 106 for combustion. In this embodiment, a motor 108 for the fan 102 may be attached by known methods to an outer surface 110 of the first chamber 106, or to the interior of the sleeve body 26 itself. The motor 108 may even be located outside of the second chamber 104, and communicate motion to the fan 102 by a rotating shaft 112 into the second chamber, as is known in the art.

Similar to the embodiment illustrated in FIG. 4, airflow through the apparatus 100 travels in the direction B when the second chamber 104 is positioned to allow airflow into the chambers 104, 106 from outside of the apparatus, when the fan 102 is positioned in the second chamber. Purging combustion by-products from the chambers 104, 106 can therefore be executed nearly as efficiently with a fan in the second chamber instead of the first chamber. Alternatively, the fan 24 (FIG. 4) may be located in the first chamber 106, in addition to the fan 102 in the second chamber 104, to provide even greater airflow through both chambers in the direction B. Those skilled in the art will be apprised that airflow may be even further facilitated through chambers configured in addition to the chambers 104, 106 by the location of fans in such additional chambers alone, or in combination with a fan in the second chamber and/or the first chamber.

The embodiments described above provide significant advantages to be realized for multiple-chamber combustion-powered apparatuses. The configuration of the present invention allows such an apparatus to achieve high-energy combustions from the use of airflow restrictive paths during combustion events, while also allowing airflow to bypass the restrictive paths for ancillary events in between combustion events. A fan in at least one of the chambers can therefore achieve a consistently significant and efficient flow, no matter how restricted is the path from one chamber to the next. The present invention also provides improved circulation/recirculation between chambers to improve mixing, even when fuel is injected in to only one chamber.

A further advantage realized by the present invention is that the fan rotational flow may operate in these preferred configurations independently of the other design considerations relating to communication between the multiple chambers through the flame jet port and the restricted path connecting the chambers. Accordingly, the undesirable tradeoff described above—between high-energy combustion and efficiently executed ancillary processes—is effectively eliminated by the present combustion apparatus embodiments. Consistent and efficient fan functioning also prevents some long-term wear on the internal parts of the combustion engine of the apparatus. Although described in relation to a dual-chamber combustion apparatus, those skilled in the art will realize that the embodiments described above may be adapted to devices utilizing more than two chambers, without departing from the present invention. Those skilled in the art are also apprised that the present airflow configurations may also be effectively employed in other multiple-chamber combustion or pneumatic devices which drive a piston or firing mechanism, as well as devices powered by combustion in general.

While particular embodiments of the combustion mechanism of the present invention have been shown and described, it will also be appreciated by those skilled in the art that changes and modifications may be made thereto without departing from the invention in its broader aspects, and as set forth in the following claims.

What is claimed is:

1. A gas combustion-powered apparatus, comprising:

a first chamber;

a rotatable fan located in said first chamber;

ignition means in operable relationship to said first chamber to ignite a combustible gas;

a second chamber;

first communication means between said first chamber and said second chamber and downstream of said fan, said first communication means constructed and arranged for enabling passage of an ignited gas jet from said first chamber to said second chamber;

at least one intake port located on a wall of said first chamber upstream of said rotatable fan; and at least one bypass port, separate from said first communication means, and located on said wall of said first chamber downstream of said rotatable fan.

2. The apparatus of claim 1, further comprising:

a piston chamber including a piston disposed within said piston chamber; and second communication means between said second chamber and said piston chamber, said second communication means constructed and arranged for enabling a combustion pressure in said second chamber to drive said piston in a direction away from said second chamber.

3. The apparatus of claim 2, wherein said second chamber includes first and second opposing ends, said second chamber is constructed and arranged for moveable disengagement from said first chamber and said piston chamber at said first and second ends respectively.

4. The apparatus of claim 3, wherein a distance between said first chamber and said piston chamber is generally constant, and moveable engagement of said second chamber restricts airflow into said first and second chambers from outside the apparatus at said first and second ends.

5. The apparatus of claim 1, further comprising at least one intake seal moveable to cover said intake port and restrict airflow between said first and second chamber through said intake port.

6. The apparatus of claim 5, further comprising at least one bypass seal moveable to cover said bypass port and restrict airflow between said first and second chambers through said bypass port.

7. The apparatus of claim 6, wherein said at least one intake seal and bypass seal are moveable relative to said first chamber, but fixed relative to said second chamber.

8. The apparatus of claim 7, wherein said at least one intake seal includes at least one opening to allow airflow between said intake seal and an interior wall of said second chamber.

9. The apparatus of claim 7, wherein said at least one bypass seal includes at least one opening to allow airflow between said bypass seal and an interior wall of said second chamber.

10. The apparatus of claim 1, wherein said first communication means is a flame jet port, and includes a restrictive airflow path between said first and second chambers including at least one of a valve, a shroud, and a limiter disposed to cover said flame jet port.

11. A gas combustion-powered apparatus, comprising:

a combustion chamber;

a piston chamber housing a moveable piston;

a sleeve chamber moveable relative to said combustion chamber and said piston chamber;

said sleeve chamber having a first sliding position allowing unrestricted airflow between said first and second chambers, and unrestricted airflow from outside the apparatus into at least one of said first and second chambers;

said sleeve chamber having a second sliding position allowing unrestricted airflow between said first and second chambers, but blocking airflow from outside the apparatus into said first and second chambers; and said sleeve chamber having a third sliding position restricting airflow between said first and second chambers, and blocking airflow from outside the apparatus into said first and second chambers.

12. The apparatus of claim 11, wherein airflow through the apparatus is facilitated by a rotatable fan disposed within said combustion chamber.

13. The apparatus of claim 12, further comprising:

at least one intake port located on a wall of said combustion chamber upstream of said fan; and at least one bypass port located on said wall downstream of said fan;

wherein, in said first sliding position, said first and second chambers are in open communication with each other through said at least one intake port and said at least one bypass port.

14. The apparatus of claim 13, wherein, in said first sliding position, at least one of said first and second chambers is in open communication with air from outside the apparatus through openings between said combustion chamber and said sleeve chamber, and between said sleeve chamber and said piston chamber, respectively.

15. The apparatus of claim 14, wherein, in said second sliding position, first and second ends of said sleeve chamber block from airflow said openings between said combustion chamber and said sleeve chamber, and between said sleeve chamber and said piston chamber, respectively.

16. The apparatus of claim 15, wherein said at least one intake seal and bypass seal are fixedly attached to an interior dimension of said sleeve chamber and, in said third sliding position, said at least one intake seal and said at least one bypass seal cover to block from airflow at least one intake port and at least one bypass port respectively.

17. The apparatus of claim 11, wherein an overall distance said sleeve chamber slides defines a stroke length S, a distance said sleeve chamber progressively slides from said first sliding position to said second sliding position defines a first stroke length fraction S1, a distance said sleeve chamber progressively slides from said second sliding position to said third sliding position defines a second stroke length fraction S2, such that a resulting relationship is $S \geqq S1+S2$.

18. The apparatus of claim 11, wherein airflow through the apparatus is facilitated by a rotatable fan disposed within said sleeve chamber.

19. A method of operating a combustion-powered apparatus having a combustion chamber, a sliding chamber, and a piston chamber, comprising the steps of:

providing air to the combustion chamber;

injecting fuel into the combustion chamber containing air;

mixing said air and said fuel in the combustion chamber and the sliding chamber by an operation of a rotating fan in the combustion chamber, at least one upstream port located on a wall of the combustion chamber upstream of said fan and in communication with the sliding chamber, and at least one downstream port located on said wall downstream of said fan and in communication with the sliding chamber;

igniting said mixed air and fuel from said mixing step in the combustion chamber and communicating said ignited mixture to the sliding chamber through a flame jet port in the combustion chamber;

driving a piston in the piston chamber from combustion pressure in the sliding chamber from said igniting step; and purging combustion by-products from said igniting step from the combustion chamber and the sliding chamber by sending fresh air from outside the apparatus through the combustion chamber and the sliding chamber.

20. The method of claim 19, wherein said injecting step further comprises a substep of blocking airflow from outside of the apparatus into the combustion chamber and sliding chamber.

21. The method of claim 19, wherein said igniting step further comprises a substep of blocking airflow through said upstream and downstream ports.

22. The method of claim 19, wherein said purging step further comprises a substep of moving the sliding chamber to unblock said upstream and downstream ports and to allow airflow into at least one of the sliding chamber and combustion chamber from outside the apparatus.

23. A gas combustion-powered apparatus, comprising:

a first chamber;

ignition means in operable relationship to said first chamber to ignite a combustible gas;

a second chamber;

a rotatable fan located in at least one of said first chamber and said second chamber;

first communication means between said first chamber and said second chamber, said first communication means constructed and arranged for enabling passage of an ignited gas jet from said first chamber to said second chamber;

at least one intake port located on a wall of said first chamber; and at least one bypass port, separate from said first communication means and said at least one bypass port, and located on said wall of said first chamber between said intake port and said communication means.

* * * * *